US005630908A

United States Patent [19]

Viertola

[11] Patent Number: 5,630,908

[45] Date of Patent: *May 20, 1997

[54] METHOD IN THE OPERATION OF A DOCTOR IN A PAPER/BOARD MACHINE

[75] Inventor: Arvo Viertola, Säynätsalo, Finland

[73] Assignee: Valmet Corporation, Helsinki, Finland

[ * ] Notice: The term of this patent shall not extend beyond the expiration date of Pat. No. 5,484,482.

[21] Appl. No.: 310,626

[22] Filed: Sep. 22, 1994

[30] Foreign Application Priority Data

Sep. 23, 1993 [FI] Finland ..... 934173

[51] Int. Cl.[6] ..... D21F 1/32

[52] U.S. Cl. ..... 162/199; 15/256.51; 118/104

[58] Field of Search ..... 15/256.5, 256.51, 15/256.52; 162/281, 199, 272, 198, 252; 118/261, 104, 118; 427/356

[56] References Cited

U.S. PATENT DOCUMENTS

| | | | |
|---|---|---|---|
| 1,317,100 | 9/1919 | Plant | 162/281 |
| 2,155,083 | 4/1939 | Drewsen | 118/70 |
| 3,166,464 | 1/1965 | Eolkin | 15/256.51 |
| 3,195,500 | 7/1965 | Kuhnel | 118/70 |
| 4,080,059 | 3/1978 | Tani et al. | 15/256.51 |
| 4,258,650 | 3/1981 | McCrocklin et al. | 118/118 |
| 4,852,209 | 8/1989 | Svenko et al. | 15/256.51 |
| 5,219,618 | 6/1993 | Daniels | 15/256.51 |
| 5,484,402 | 1/1996 | Rantanen et al. | 15/256.51 |

FOREIGN PATENT DOCUMENTS

| | | |
|---|---|---|
| 972997 | 8/1975 | Canada . |
| 47399 | 8/1972 | Finland . |
| 921194 | 9/1993 | Finland . |

*Primary Examiner*—Brenda A. Lamb

*Attorney, Agent, or Firm*—Steinberg, Raskin & Davidson, P.C.

[57] ABSTRACT

A method and device in the operation of a doctor blade in a paper machine/board machine in which different quantities of lubricating medium are supplied into different areas in the longitudinal direction, i.e., along the width, of the doctor blade, independent of one another. A larger amount of lubricating medium is supplied into the area having the maximum extent of wear of the doctor blade.

15 Claims, 5 Drawing Sheets

METHOD IN THE OPERATION OF A DOCTOR IN A PAPER/BOARD MACHINE

BACKGROUND OF THE INVENTION

The present invention relates to a method and device in the operation of a doctor in a paper machine/board machine.

In conventional paper machines and board machines having center rolls, the doctor blades associated with the center roll of the press are worn one-sidedly. This results from a number of properties which vary in the cross direction of the machine. Uneven wear is affected by such factors as the temperature, air flows, etc.

Uneven wear of the doctor blade results in the rapid replacement of the doctor blade. Thus, when wear of the blade at points along its length is measured, and when the wear at any of these points exceeds a permitted maximal wear, the blade must be replaced.

At present, the doctors are provided with lubrication jets of doctors which are designed to be symmetric. However, it is a disadvantage of this symmetric distribution of lubricant by the lubrication jets that a larger amount of lubricant is needed in the portion of the blade width that is worn more rapidly.

OBJECTS AND SUMMARY OF THE INVENTION

It is an object of the present invention to provide a new and improved method and device to cause the doctor blade to wear more uniformly. If the wear of the blade can be made more uniform, it is possible to extend the service life of the blade and to increase the interval of necessary replacement of the blade.

In accordance with the method and device of the invention, lubricating jets are applied in connection with the doctor in order to equalize the wear of the doctor blades so that a larger amount of lubricant is introduced in the portion of the blade width that is worn more rapidly. Quantities of lubricating medium are supplied into respective areas in the longitudinal direction of the doctor blade. The quantity supplied into each respective area is independent of the other quantities. In a preferred embodiment, a lubrication jet pipe for conveying lubricating medium is divided into different sections of a desired length so that a variable amount of lubricating medium can be dispersed through each separate length of pipe. In a preferred embodiment, different quantities of the lubricating medium are introduced through separate pipe constructions to different portions along the width of the doctor. A profiled lubrication jet may also be used to equalize the wear profile of the blade.

In the method in accordance with the invention in the operation of a doctor, in connection with the doctor blade, different quantities of lubricating medium are supplied into different areas along the width of the doctor blade. The quantities of lubricating medium are passed independent of one another into each of the different areas so that a larger amount of lubricating medium can be supplied into the area having the maximum extent of wear of the doctor blade. The flow quantity per unit of time of lubricating medium into and out of each compartment is also measured. In a preferred embodiment, the lubricating medium is water which is sprayed from a jet pipe onto a face of a roll against which the doctor blade is placed. Alternatively, a plurality of jet pipes can be provided whereby each of the jet pipes extends along only one area in the longitudinal direction of the doctor blade.

In the device in accordance with the invention, means for supplying lubricating medium are provided in proximity to the doctor and are preferably ducts for passing a lubricating medium therethrough. Different quantities of lubricating medium are passed through the ducts into different portions or areas along the width of the doctor, i.e., in the longitudinal direction of the doctor blade, independent of one another. The quantity of lubricating medium being supplied into the different areas is regulated so that it is possible to supply a larger amount of lubricating medium into an area having the maximum extent of wear of the doctor blade. Preferably, the lubricating medium is supplied by a jet pipe having a frame mantle defining an interior space, jet nozzles arranged in the frame mantle and means for defining a plurality of compartments in the interior space of the jet pipe.

The invention will be described in the following with reference to some preferred embodiments of the invention illustrated in the figures in the accompanying drawing. However, the invention is not confined to these illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
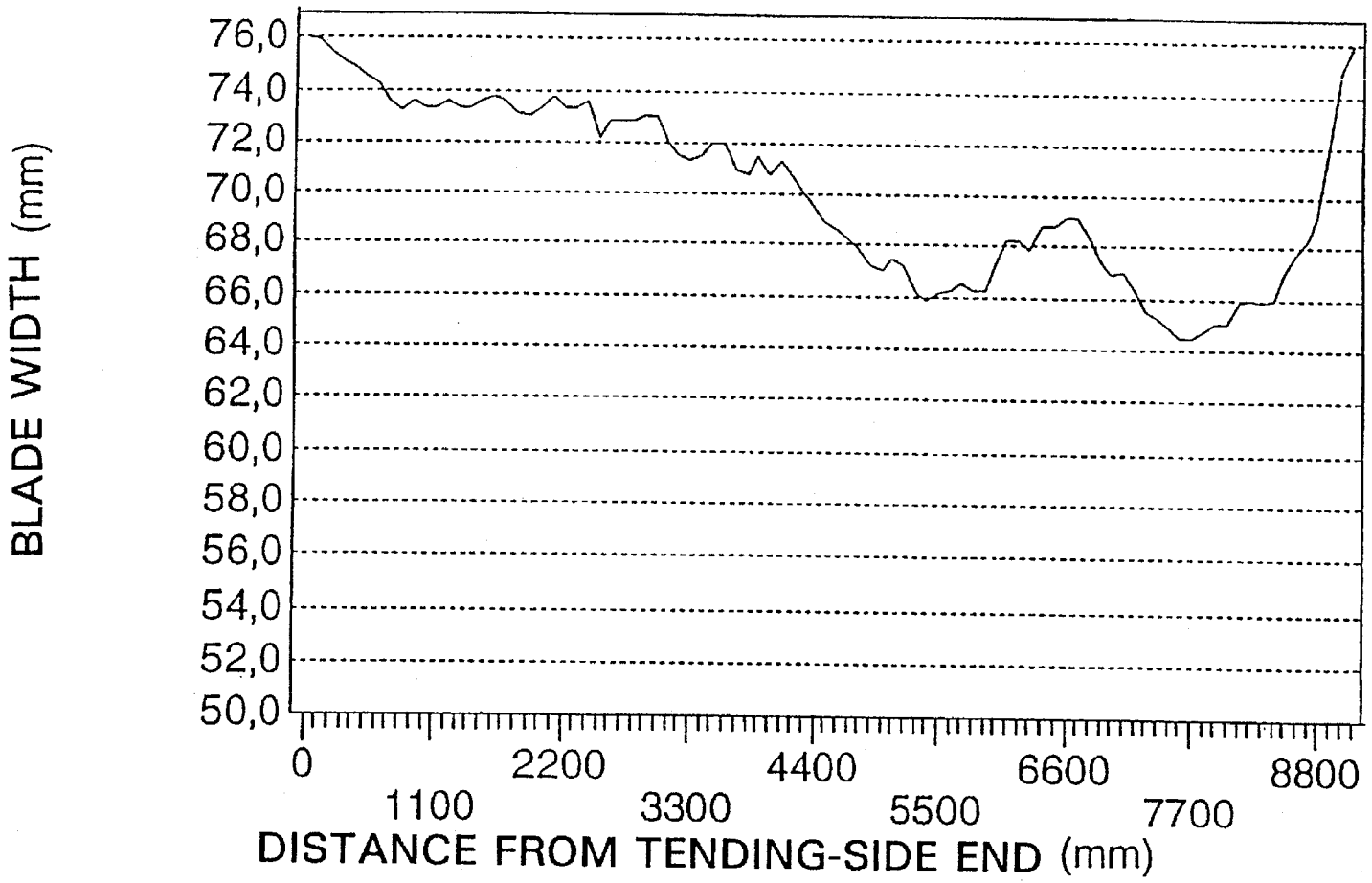
FIG. 1 is a graphic illustration of the measured wear of a doctor blade in prior art operation of a doctor.

Referring to the drawings wherein like reference numerals refer to the same elements, FIG. 1 illustrates the wear taking place in prior art doctor operations with uniform and symmetric supply of lubricating medium. The vertical system of coordinates represents the measured blade width. The distance from the tending-side end is indicated in the horizontal system of coordinates as millimeters. As shown in the chart, the measured wear of the doctor blade is uneven, increasing toward the driving-side end (away from the tending-side end).

Figure 2A:
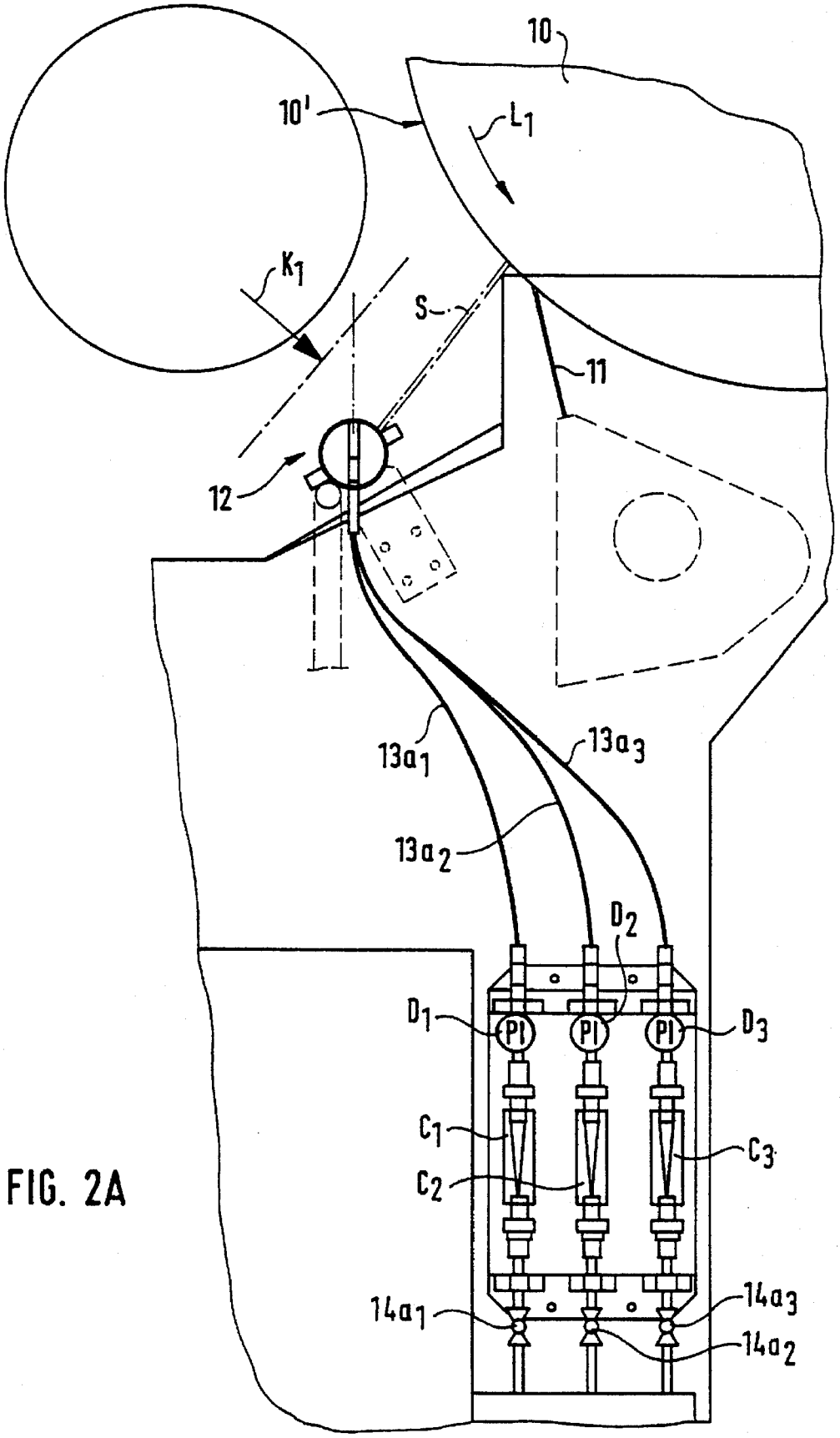
FIG. 2A shows the device in accordance with the invention, and used in the method in accordance with the invention, viewed in the cross direction of the paper machine.

FIG. 2A is a side view of the device in accordance with the invention in which a doctor blade 11 doctors a face of a roll 10 and a jet S is introduced from a jet pipe 12 to the forward side of the doctor blade 11. The direction of rotation of the roll is indicated by arrow $L_1$. Three lubricant ducts are passed into the jet pipe 12, i.e., ducts $\mathbf{13}a_1$,$\mathbf{13}a_2$ and $\mathbf{13}a_3$, and each duct comprises regulation means, such as regulation valves $\mathbf{14}a_1$,$\mathbf{14}a_2$,$\mathbf{14}a_3$, for regulating the flow quantity of lubricating medium to the respective duct. Flow meters and pressure gauges $C_1,C_2,C_3,D_1,D_2,D_3$ are also positioned between the valves $14a_1,14a_2,14a_3$ and the ducts $13a_1,13a_2,13a_3$. As such, it is possible to monitor and measure the amount of flowing lubricating medium passing into compartments in formed in the interior of the jet pipe 12 along the width thereof, i.e., in a direction transverse to the running direction of the roll. Through the duct $13a_1$, the lubricating medium is passed into the compartment $G_1$ in the interior of the jet pipe 12. Through the duct $13a_2$, the lubricating medium is passed into the compartment $G_2$ in the interior of the jet pipe 12, and through the duct $13a_3$, the lubricating medium is passed into the compartment $G_3$ in the interior of the jet pipe 12.

Figure 2B:
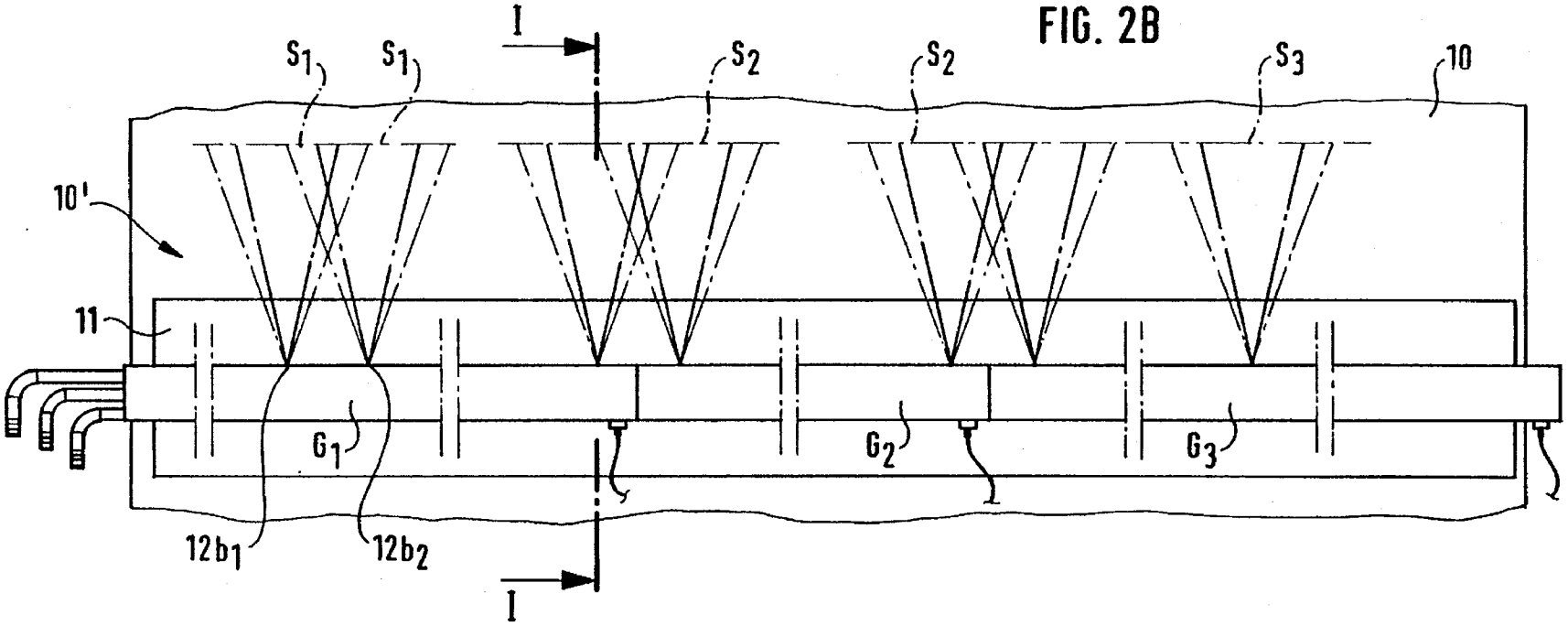
FIG. 2B shows the device in accordance with the invention viewed in the direction of the arrow $K_1$ in FIG. 2A.

FIG. 2B shows the device in accordance with the invention when viewed in the direction of arrow $K_1$ in FIG. 2A. Lubricant jets $S_1$ are produced or dispersed from the compartment $G_1$, lubricant jets $S_2$ are produced from the compartment $G_2$, and lubricant jets $S_3$ are produced from the compartment $G_3$. Thus, in the illustrated embodiment, the jet pipe 12 has been divided or partitioned into three separate compartments in the longitudinal direction of the jet pipe, i.e., along its width, which preferably corresponds to, and is coextensive with, the longitudinal direction of the doctor blade and its width. The jet pipe may divided into any number of compartments as desired. Through each compartment, a desired quantity of medium flow per meter of doctor width per unit of time is produced. In this manner, by regulating the quantity of lubricating medium, it is possible to equalize the wear of the doctor blade 11, i.e., by increasing the amount of lubricant at the portion(s) of the width of the doctor blade at which the most intensive wear has been noted.

Figure 2C:
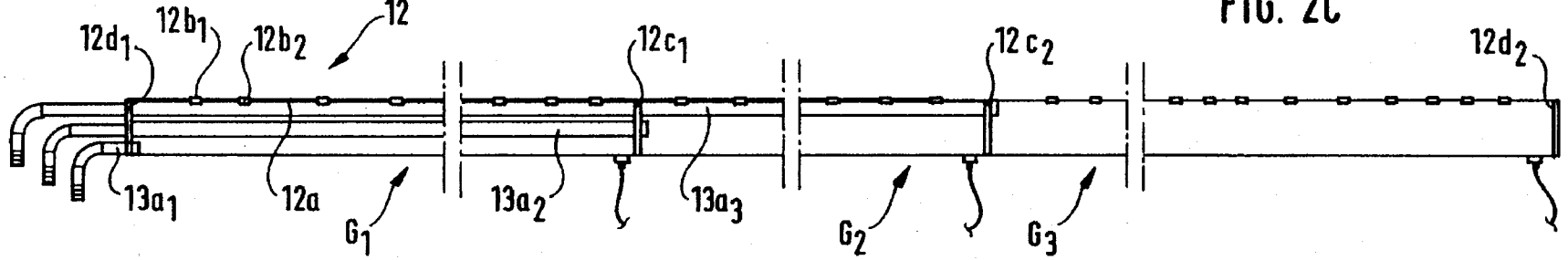
FIG. 2C is a cross-sectional view of an embodiment of the invention wherein the device is a jet pipe.

FIG. 2C is a cross-sectional view of the jet pipe 12. The jet pipe 12 comprises a frame mantle 12*a* having jet nozzles $12b_1,12b_2, \ldots$, partition walls $12c_1,12c_2$ and end walls $12d_1,12d_2$ arranged therein. The partition walls are arranged in the interior of the jet pipe while the end walls define an enclosed interior space within the jet pipe. By positioning a desired number of partition walls, the interior of the jet pipe 12 is divided into the compartments $G_1$, $G_2$ and $G_3$. The lubricant duct $13a_1$ passes into the compartment $G_1$. The lubricant duct $13a_2$ passes through compartment $G_1$ into the compartment $G_2$, and the lubricant duct $13a_3$ passes through compartments $G_1$ and $G_2$ into the compartment $G_3$. As the lubricating medium, preferably water is used. Other conventional lubricating medium are also applicable. Each compartment $G_1$, $G_2$ and $G_3$ comprises an emptying plug $20a_1,20a_2$, $20a_3$, which is placed underneath, i.e., at a lowermost position, when the pipe is installed in its position with respect to the doctor blade. When the plug is removed, i.e., moved to its open position, the compartments $G_1,G_2,G_3$ can be emptied and drained of water independently from one another.

Figure 2D:
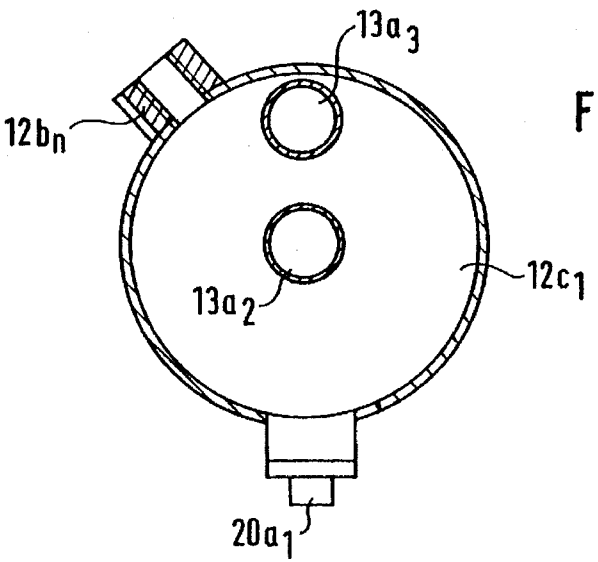
FIG. 2D is a cross-sectional view taken along the line I—I in FIG. 2B.

FIG. 2D is a cross-sectional view taken along the line I—I in FIG. 2B. As shown in FIG. 2D, a water jet is passed from the compartment $G_1$ through the jet nozzles $12b_1,12b_2, \ldots$ at and onto the face 10' of the roll 10 and prior to a point of engagement of the roll with the doctor blade. Thereafter, the water from the water jet is carried further on the roll face into connection with the doctor blade 11 to lubricate the same.

Figure 3:
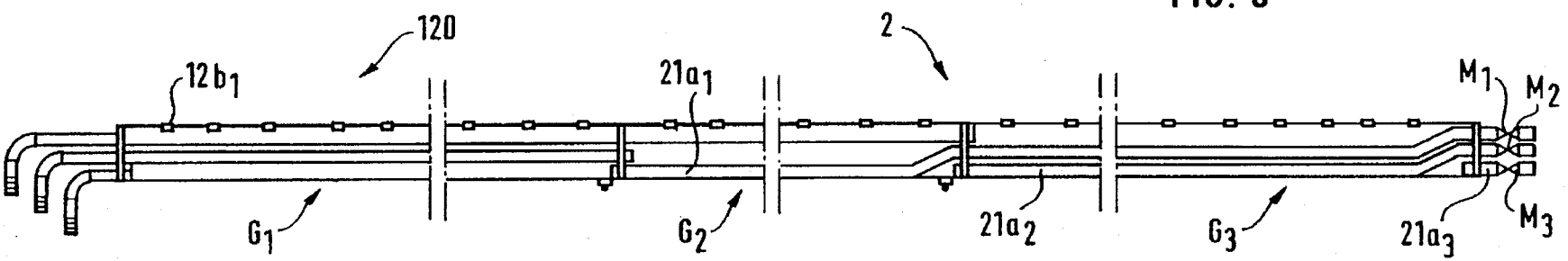
FIG. 3 shows another embodiment of the invention wherein the device is a jet pipe.

FIG. 3 shows an embodiment of the invention in which a jet pipe 120, shown in a cross-sectional view, which additionally comprises an exhaust duct $21a_1,21a_2,21a_3$ passing from each compartment $G_1,G_2,G_3$ so that each compartment $G_1,G_2,G_3$ can also be emptied by running cleaning fluid, possibly the lubricating medium, therethrough by opening closing valves $M_1,M_2,M_3$ connected with a respective one of the exhaust ducts.

Figure 4:
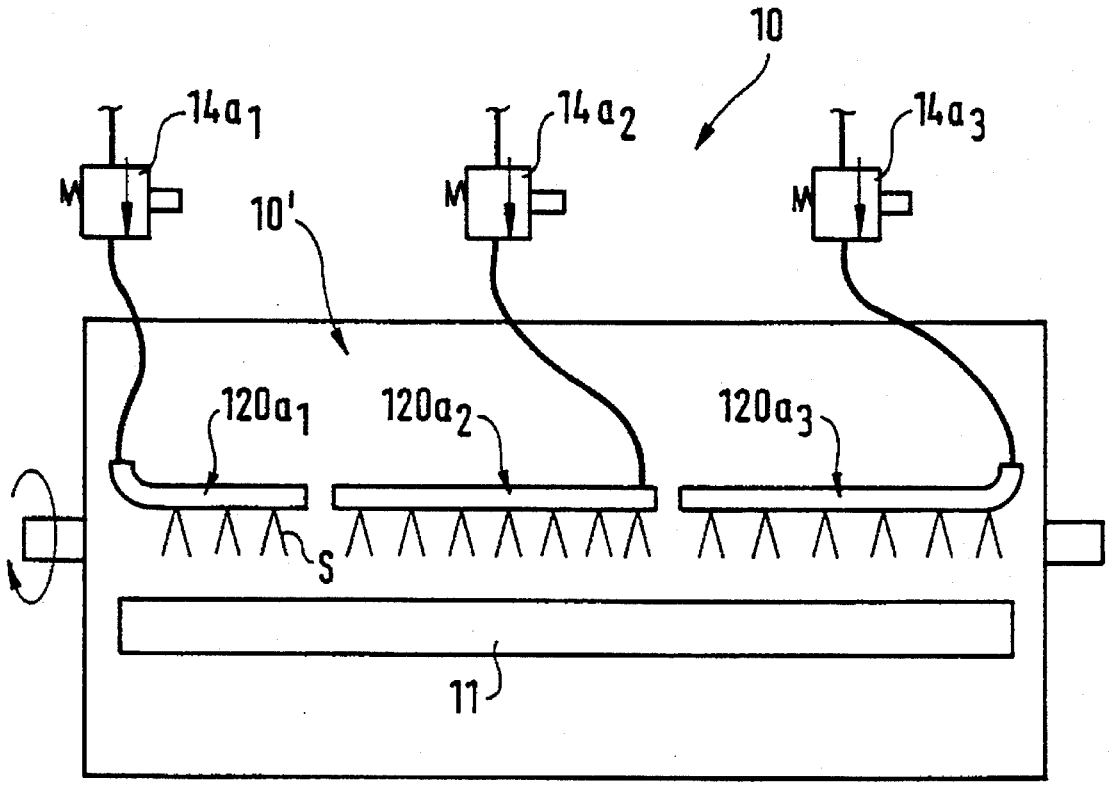
FIG. 4 is another embodiment of the invention in which, on the whole, different quantities of lubricant are supplied to different points along the width of the doctor in order to equalize the blade wear.

FIG. 4 shows an embodiment of the invention in which there are three separate jet pipes, i.e., jet pipes $120a_1,120a_2,120a_3$. Each jet pipe extends along only one specific area in the longitudinal direction of the doctor blade. The amount of lubricating medium supplied by each separate jet pipe is regulated by respective regulation means, e.g., a regulation valve $14a_1,14a_2,14a_3$.

The examples provided above are not meant to be exclusive. Many other variations of the present invention would be obvious to those skilled in the art, and are contemplated to be within the scope of the appended claims.

I claim:

1. Method in the operation of an elongate doctor blade in a paper machine/board machine in which a lubricating medium is introduced in connection with the doctor blade, the doctor blade being arranged to engage and be operable against an opposed moving surface, comprising the steps of:

partitioning a jet pipe into a plurality of compartments, directing a quantity of lubricating medium into each of the compartments, supplying the lubricating medium from the compartments into different areas in the longitudinal direction of the doctor blade at a location proximate to and before engagement of the doctor blade with the opposed moving surface such that the lubricating medium is present during engagement of the doctor blade with the opposed moving surface, and regulating the quantity of lubricating medium being supplied into the different areas independent of one another to supply a larger amount of lubricating medium into an area having a larger extent of wear of the doctor blade.

2. The method of claim 1, further comprising the step of measuring the flow quantity per unit of time of lubricating medium through each of the compartments.

3. The method of claim 1, wherein the lubricating medium is water and the opposed moving surface is a face of a rotating roll, the step of supplying the water from the compartments into different areas in the longitudinal direction of the doctor blade comprising the step of spraying water from the compartments onto the face of the roll against which the doctor blade is placed at a location proximate to and before the doctor blade in a direction of rotation of the roll.

4. The method of claim 1, further comprising the steps of:

providing a plurality of jet pipes, each of the jet pipes extending along only one area in the longitudinal direction of the doctor blade, and supplying the lubricating medium from the jet pipes to be introduced in connection with the doctor blade.

5. The method of claim 1, wherein the moving surface opposed to the doctor blade is a face of a roll.

6. Method in the operation of an elongate doctor blade in a paper machine/board machine in which a lubricating medium is introduced in connection with the doctor blade, comprising the steps of:

spraying quantities of lubricating medium onto a face of a roll against which the doctor blade is placed at a location proximate to and before the doctor blade in a direction of rotation of the roll, the lubricating medium being spraying onto different areas of the roll face in the longitudinal direction of the doctor blade, and regulating the quantity of lubricating medium being sprayed onto the different areas of the roll face independent of one another to supply a larger amount of lubricating medium into an area having a larger extent of wear of the doctor blade.

7. The method of claim 6, further comprising the steps of:

directing the lubricating medium into a jet pipe, and then spraying the lubricating medium from the jet pipe onto the different areas of the roll face.

8. The method of claim 6, wherein the lubricating medium is water.

9. The method of claim 6, further comprising the steps of:

partitioning a jet pipe into a plurality of compartments, and directing a variable quantity of lubricating medium into each of the compartments to be sprayed onto a respective area of the roll face.

10. The method of claim 9 further comprising the step of measuring the flow quantity per unit of time of lubricating medium through each of the compartments.

11. The method of claim 6, further comprising the steps of:

providing a plurality of jet pipes, each of the jet pipes extending along only one area in the longitudinal direction of the doctor blade, and spraying the lubricating medium from the jet pipes to be introduced onto a respective area of the roll face.

12. Method in the operation of an elongate doctor blade in a paper machine/board machine in which a lubricating medium is introduced in connection with the doctor blade, the doctor blade being arranged to engage and be operable against an opposed moving surface, comprising the steps of:

providing a plurality of jet pipes, each of the jet pipes extending along only one area in the longitudinal direction of the doctor blade, supplying a quantity of lubricating medium from each of the jet pipes to be introduced in connection with the doctor blade into a respective one of the areas in the longitudinal direction of the doctor blade at a location proximate to and before engagement of the doctor blade with the opposed moving surface such that the lubricating medium is present during engagement of the doctor blade with the opposed moving surface, and regulating the quantity of lubricating medium being supplied into the different areas independent of one another to supply a larger amount of lubricating medium into an area having a larger extent of wear of the doctor blade.

13. The method of claim 12, further comprising the step of measuring the flow quantity per unit of time of lubricating medium through each of the jet pipes.

14. The method of claim 12, wherein the lubricating medium is water and the opposed moving surface is a face of a rotating roll, further comprising the step of spraying water from the jet pipes onto the face of the roll against which the doctor blade is placed.

15. The method of claim 12, wherein the moving surface opposed to the doctor blade is a face of a roll.

* * * * *